US007238265B2

(12) United States Patent
Wang et al.

(10) Patent No.: US 7,238,265 B2
(45) Date of Patent: Jul. 3, 2007

(54) ELECTROPLATING APPARATUS WITH FUNCTIONS OF VOLTAGE DETECTION AND FLOW RECTIFICATION

(75) Inventors: Chih-Cheng Wang, Hsinchu (TW); Chih-Yuan Tseng, Hsinchu (TW); Jen-Rong Huang, Hsinchu (TW); Sheng-Lang Lee, Hsinchu (TW); Chia-Ming Chen, ChangHua (TW); Pang-Ming Chiang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 539 days.

(21) Appl. No.: 10/743,496

(22) Filed: Dec. 23, 2003

(65) Prior Publication Data

US 2005/0051425 A1 Mar. 10, 2005

(30) Foreign Application Priority Data

Sep. 9, 2003 (TW) ..... 92124803 A

(51) Int. Cl.
*C25B 9/04* (2006.01)
*C25F 7/00* (2006.01)

(52) U.S. Cl. ..... 204/229.8; 204/275.1

(58) Field of Classification Search ..... 204/275.1, 204/230.2, 230.5, 230.8, 229.8; 137/8
See application file for complete search history.

(56) References Cited

U.S. PATENT DOCUMENTS

| | | | | |
|---|---|---|---|---|
| 4,137,867 | A | 2/1979 | Aigo | |
| 4,466,864 | A * | 8/1984 | Bacon et al. | 205/105 |
| 4,497,345 | A * | 2/1985 | Lees | 138/39 |
| 4,906,346 | A | 3/1990 | Hadersbeck et al. | |
| 5,391,285 | A * | 2/1995 | Lytle et al. | 205/123 |
| 5,496,463 | A * | 3/1996 | Mori et al. | 205/109 |
| 5,596,152 | A * | 1/1997 | Bergervoet et al. | 73/861.83 |
| 6,024,856 | A | 2/2000 | Haydu et al. | |
| 6,027,631 | A | 2/2000 | Broadbent | |
| 6,183,195 | B1 * | 2/2001 | Tremaine | 415/145 |
| 6,432,282 | B1 * | 8/2002 | Shamouilian et al. | 204/228.1 |
| 6,517,689 | B1 * | 2/2003 | Hongo et al. | 204/228.7 |
| 6,544,391 | B1 * | 4/2003 | Peace | 204/198 |
| 6,685,814 | B2 * | 2/2004 | Uzoh et al. | 205/96 |
| 6,802,947 | B2 * | 10/2004 | Olgado et al. | 204/224 R |

* cited by examiner

*Primary Examiner*—Roy V. King
*Assistant Examiner*—Nicholas A. Smith
(74) *Attorney, Agent, or Firm*—Birch, Stewart, Kolasch & Birch, LLP

(57) ABSTRACT

The present invention provides a fountain-type electroplating apparatus with functions of voltage detection and flow rectification, comprising: an electroplating tank, a rectification device, and an overflow tank, wherein the electroplating tank is positioned inside the overflow tank, and the rectification device is arranged under the electroplating tank, in addition, the electroplating tank is composed of a shell, a cathode electrode, and an mesh shaped anode. The apparatus of the present invention further comprises: a power supplier, a switcher, a plurality of detection circuits, and a plurality of connecting line, which is used for monitoring the same.

12 Claims, 8 Drawing Sheets

ELECTROPLATING APPARATUS WITH FUNCTIONS OF VOLTAGE DETECTION AND FLOW RECTIFICATION

FIELD OF THE INVENTION

The present invention relates to a fountain type electroplating apparatus, and more particular, to a fountain-type electroplating apparatus having functions of voltage detection and flow rectification.

BACKGROUND OF THE INVENTION

Electroplating is an electrochemical process by which metal is deposited on a substrate by passing a current through the bath. Usually there is an anode (positively charged electrode), which is the source of the material to be deposited; the electrochemistry that is the medium through which metal ions are exchanged and transferred to the substrate to be coated; and a cathode, which is the substrate (the negatively charged electrode) to be coated. Plating is done in a plating bath that is usually a non-metallic tank (usually plastic). The tank is filled with electrolyte that has the metal in ionic form to be plated. The anode is connected to the positive terminal of the power supply. The anode is usually the metal to be plated (assuming that the metal will corrode in the electrolyte). For ease of operation, the metal is in the form of nuggets and placed in an inert metal basket made out non-corroding metal (such as titanium or stainless steel). The cathode is the substrate to be plated which is connected to the negative terminal of the power supply. The power supply is well regulated to minimize ripples as well to deliver a steady predictable current. As the current is applied, positive metal ions from the solution are attracted to the negatively charged cathode and deposit on the cathode. As a replenishment for these deposited ions, the metal from the anode is dissolved and goes into the solution and balances the ionic potential. The electroplating process can increase the surface brightness and the corrosion resistance of the object to be plated. Following the rapid development of integrated circuit (IC), the quality requirement for wafer electroplating is becoming more and more demanding for fulfilling the increasing needs of IC applications. There are several prior arts concerning the techniques of fountain-type electroplating apparatus and the monitoring devices for the same, for example, the U.S. Pat. No. 6,024,856 disclosed an electrolytic plating process having a substantially steady state electrolyte, wherein the plating properties of the deposit remain constant, but having no electrolytic rectifier for increasing the homogenous of the flow field; the U.S. Pat. No. 4,137,867 disclosed an improved apparatus for bump-plating semiconductor wafer, but having no real-time current monitoring device for enhancing the stability of the electroplating process; and the U.S. Pat. No. 4,906,346 disclosed an improved electroplating apparatus having an electroplating cell for producing finely structure, thick metal depositions of semiconductor wafers, but providing no solution for edge effect so as to generate a good current distribution; and further U.S. Pat. No. 6,027,631 disclosed a cathode joint of single-point contact, which is prone to incur the unevenness of charge distribution.

Please refer to FIG. 1, which is an illustration of a fountain-type electroplating apparatus of prior arts. The electroplating apparatus mainly comprises a plating tank 102, an overflow tank 104, and a pipe 106. Wherein, the plating tank 102 is positioned inside the overflow tank 104 and further comprises a cathode electrode 122 having a substrate attached under thereof, a shell 112, and an mesh shaped anodemesh shaped anode 114 which is a metal plate having plural holes 116. Moreover, an input hole 118 which is connected to the pipe 106 and an exit hole 120 are arranged at the bottom of the overflow tank 104. Restricted by the space of plating apparatus, the pipe 106 is usually an L-shaped pipe so as to connect to the plating apparatus. The mesh shaped anode 114 can be made of titanium or titanium plated with platinum. The substrate 110 may be a silicon wafer.

As seen in FIG. 1, when plating solution is being transported through the pipe 106 into the overflow tank 104, the condition that the vertical length of the upward-connecting part of the pipe 106 is insufficient, or the pipe 106 is deformed, or even the pipe 106 is skewed with a certain angle will result in the plating solution 108 entering the plating tank 102 through the plural holes 116 of mesh shaped anode 114 to form an unsymmetrical flow field, such that the concentration and the flow velocity of the plating solution 108 in the plating tank 102 is not evenly distributed and further will influence the homogeneity of the plating layer.

FIG. 2 is a schematic diagram showing a connecting line and the mesh shaped anode according to the prior arts. As seen in FIG. 1 and FIG. 2, the mesh shaped anode 114 is connected to a connecting line 130 in a single-point contact and the connecting line 130 is made of materials of excellent conductivity and superior anti-oxidization capability, such as gold. Since the impedance of the connecting line 130 is lower than that of the mesh shaped anode made of titanium or titanium plated with platinum, excessive charges are prone to accumulate at the neighboring zone of the point connecting the connecting line 130 and the mesh shaped anode 114 such that the metallic ions ionized from the plating solution 108 by the mesh shaped anode 114 are distributed unevenly according to the different location of the mesh shaped anode 114. The aforesaid phenomenon will cause the different position on plating surface of the substrate 110 to be plated with different plating rate, and further will influence the homogeneity of the plating layer of the substrate 110.

In this regard, the fountain-type electroplating apparatus of the prior arts has the following shortcomings:

1. Unstable flow field existing at the interface between the plating solution and the surface of substrate not only influences the plating quality, but also reduce the plating stability and homogeneity.
2. Irregular bubbles generated at the interface between the plating solution and the substrate, and even accumulated on the surface of the substrate will result in that the plating solution can not come into touch with the surface of the substrate, and consequently the outcome is not as expected since the total plating area is changed.

SUMMARY OF THE INVENTION

The primary object of the present invention is to provide a fountain-type electroplating apparatus with functions of voltage detection and flow rectification, which is capable of providing a stable flow field to the fountain-type electroplating tank so as to enhance the homogeneity of plating layer.

Another object of the present invention is to provide a fountain-type electroplating apparatus with functions of voltage detection and flow rectification, which monitors the conductivity of the electrodes before and during the electroplating process in real time for improving the stability of electroplating process, and consequently reduce the number of defectives.

To fulfill the aforementioned objects, the present invention provides a fountain-type electroplating apparatus with functions of voltage detection and flow rectification, comprising:

an electroplating tank composed of a shell, a cathode electrode with a substrate attached under thereof, and an mesh shaped anode, wherein the cathode electrode is arranged on top of the shell and the mesh shaped anode is arranged at the bottom of the shell;

a rectification device composed of a hull, a separating plate arranged under the mesh shaped anode and a pipe connecting to the hull for transporting an electrolyte therein;

an overflow tank having an exit hole arranged at the bottom thereof;

wherein the electroplating tank is positioned inside the overflow tank, and the rectification device is arranged under the electroplating tank.

In a preferred embodiment, the fountain-type electroplating apparatus with functions of voltage detection and flow rectification of the present invention further comprises a shielding ring arranged above the mesh shaped anode.

To fulfill the aforementioned objectives, the present invention provides a fountain-type electroplating apparatus with functions of voltage detection and flow rectification, further comprising:

a power supplier having a positive electrode and a negative electrode;

a switcher having a first switching point and a corresponding second switching point;

a plurality of detection circuits, each having a first end and a second end and each of which is composed of a resistance parallel connecting to a voltmeter; and a plurality of connecting line, each having one end connecting to a joint of the mesh shaped anode, and all of each having another ends connecting jointly to a node and further connecting to both the positive electrode and the first switching point;

wherein, the first end of one of the detection circuit is connected to the switch for switching between the first switch point and the second switching point, and the first ends of the other detection circuits are connected jointly to a node and further connected to both the negative electrode and the second switching point, in addition, all the second ends of the detection circuits are respectively connected to plural joints of the substrate.

The fountain-type electroplating apparatus with functions of voltage detection and flow rectification according to the present invention is capable of providing an evenly distributed flow field rectified by the rectification device and a homogenous electric field using the preferred design of the mesh shaped anode and the allocation of conduction positions such that a preferred electroplating quality can be achieved, moreover, the plural detection circuits used in the apparatus of the present invention can monitor the stability of the resistance of the substrate caused by imperfect contact or electrolyte leakage so as to enhance current stability.

Following drawings are cooperated to describe the detailed structure and its connective relationship according to the invention for facilitating your esteemed members of reviewing committee in understanding the characteristics and the objectives of the invention.

DETAILED DESCRIPTION OF THE INVENTION

For your esteemed members of reviewing committee to further recognize and understand the characteristics, the objectives, and the functions of the invention, a preferable embodiment cooperating with corresponding drawings are presented in detail thereinafter.

Figure 1:
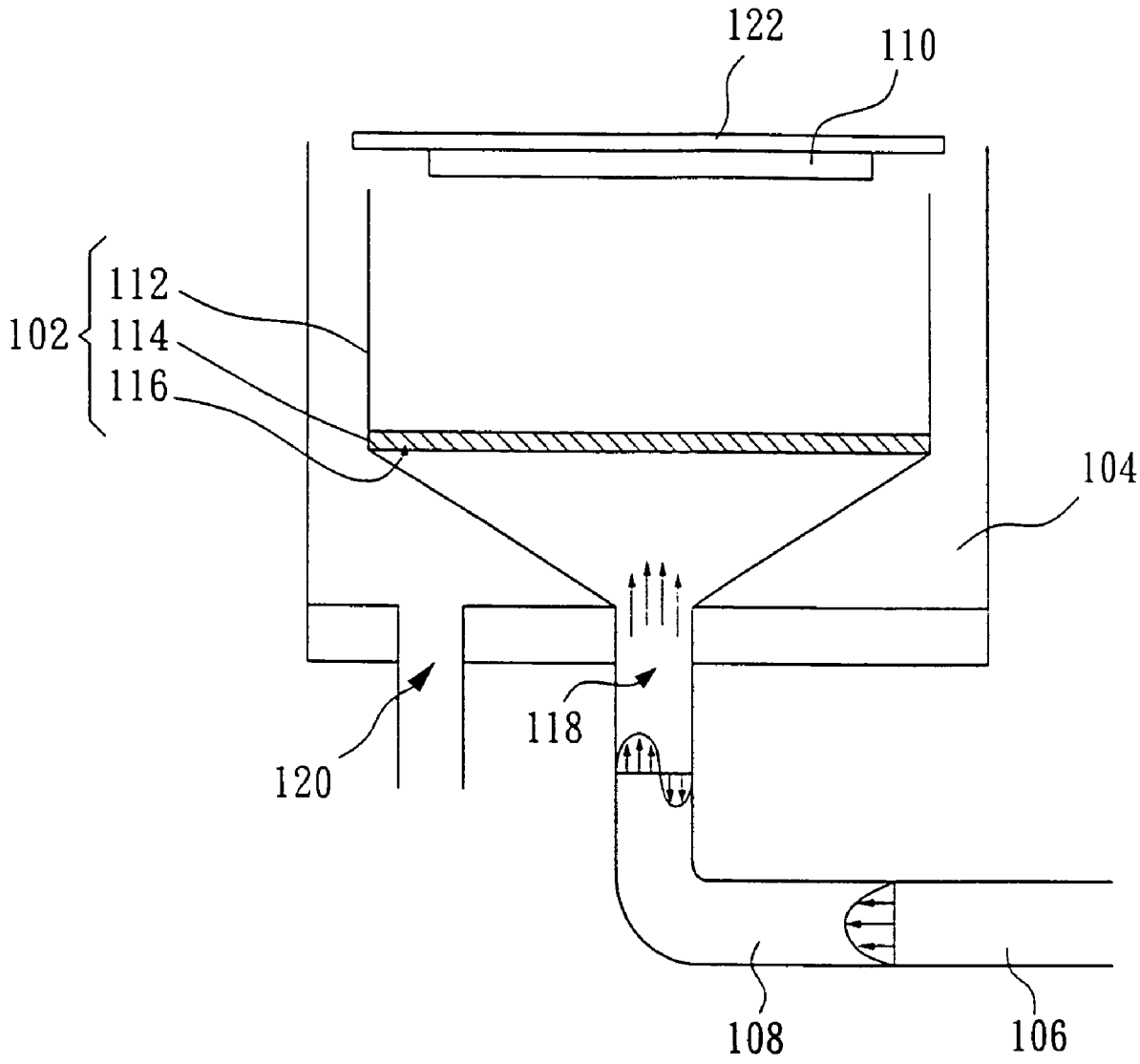
FIG. 1 is a schematic diagram showing a fountain-type electroplating apparatus of prior arts.
Figure 2:
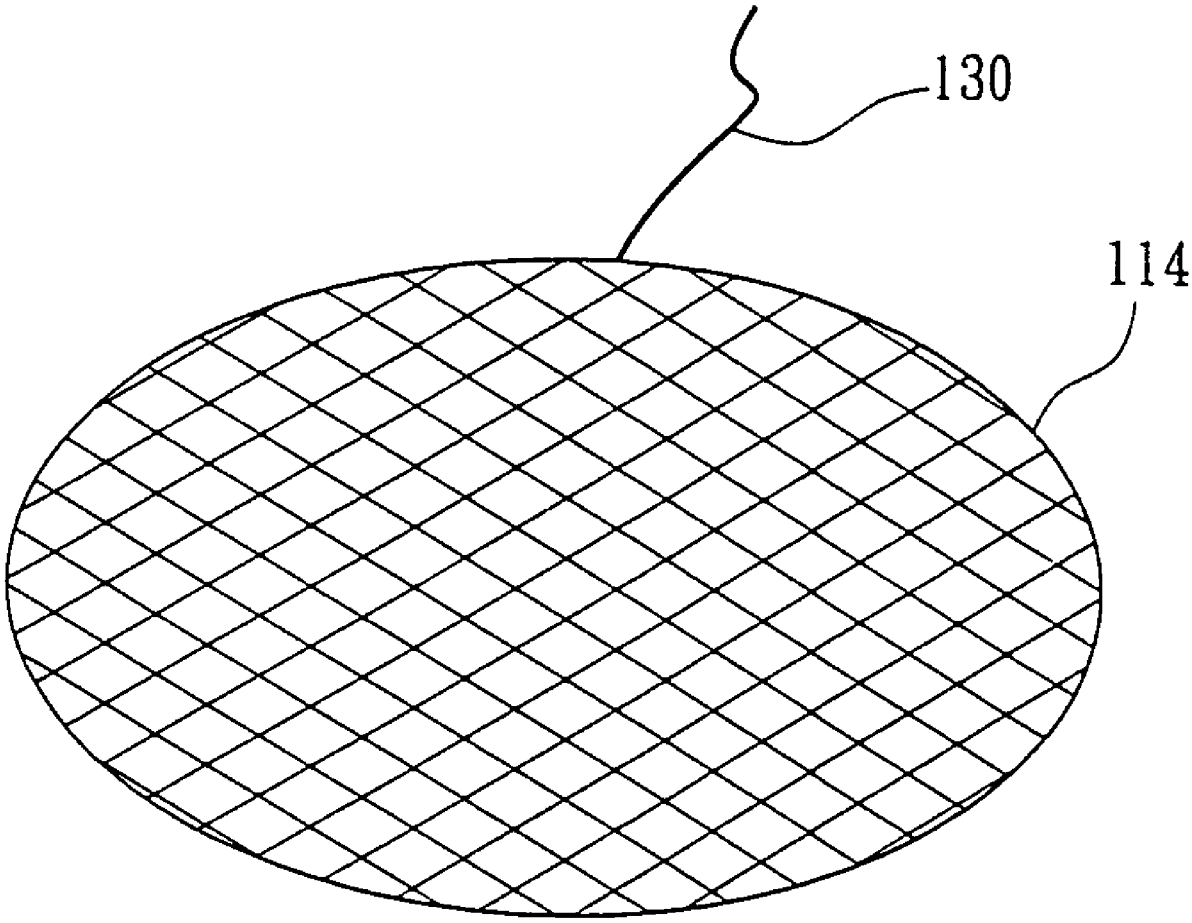
FIG. 2 is a schematic diagram depicting a connection of an mesh shaped anode and a connecting line according to the prior arts.
Figure 3:
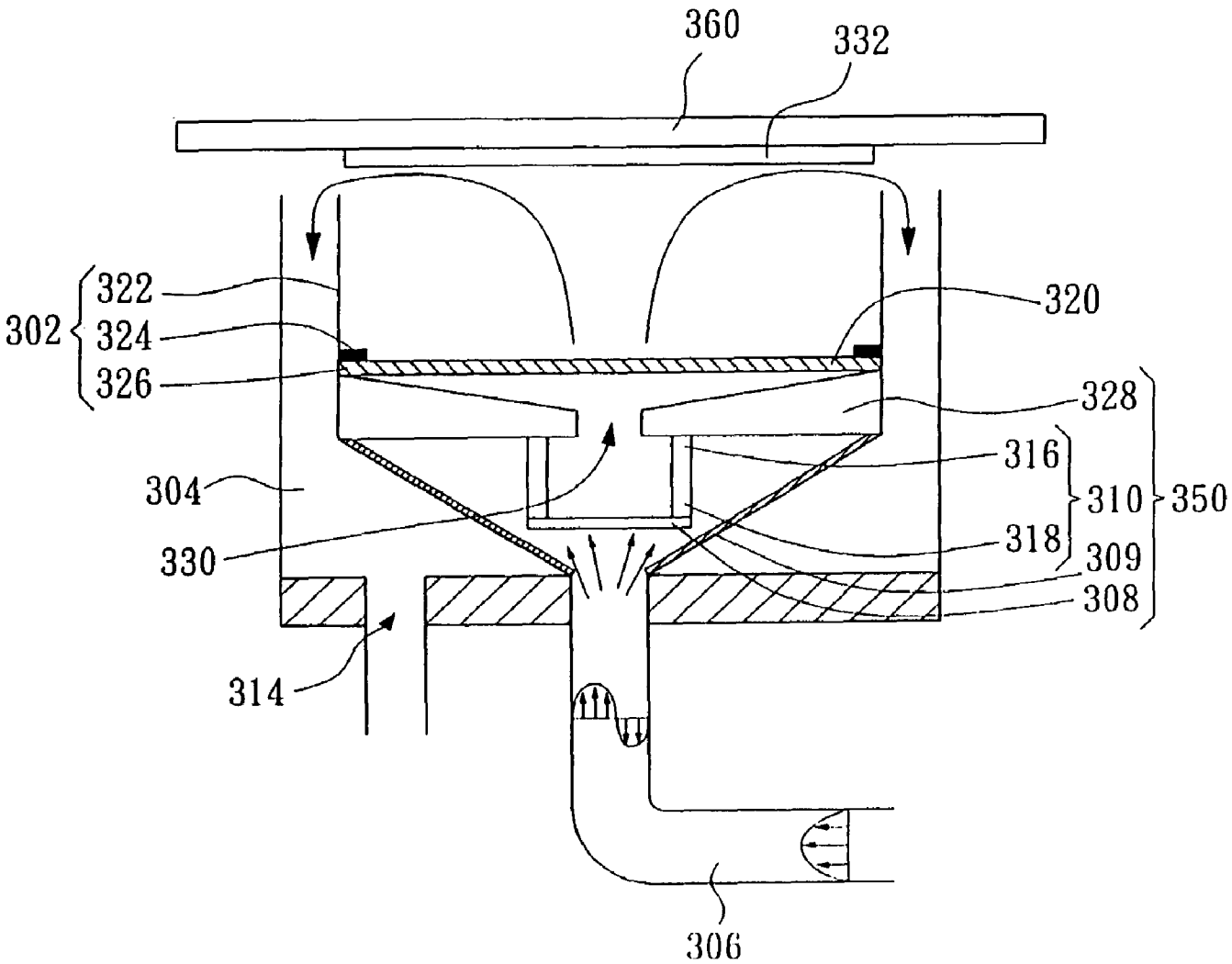
FIG. 3 is a diagram showing a preferred embodiment of the fountain-type electroplating apparatus with functions of voltage detection and flow rectification according to the present invention.

Please refer to FIG. 3, which is a diagram showing a preferred embodiment of the fountain-type electroplating apparatus with functions of voltage detection and flow rectification according to the present invention. As seen in FIG. 3, the fountain-type electroplating apparatus with functions of voltage detection and flow rectification, comprising:

an electroplating tank 302 composed of a shell 322, a cathode electrode 360 with a substrate 332 attached under thereof, and an mesh shaped anode 326 of plural holes 320, wherein the cathode electrode 360 is arranged on top of the shell 322 and the mesh shaped anode 326 is arranged at the bottom of the shell 322;

a rectification device 350 composed of a hull 309, a separating plate 328 arranged under the mesh shaped anode, a baffle 308, at least a strut 310 for connecting the separating plate 328 and the baffle 308, and a pipe 306 connecting to the hull 309 for transporting an electrolyte therein;

an overflow tank 304 having an exit hole 314 arranged at the bottom thereof such that the overflowed electrolyte can exit therefrom;

wherein the electroplating tank is positioned inside the overflow tank, and the rectification device is arranged under the electroplating tank.

In the aforesaid preferred embodiment, the substrate 332 is preferably made of silicon wafer and the mesh shaped anode 326, which is a metal plate of plural holes 320, is made of metals, such as titanium or titanium plated with platinum. In the preferred embodiment, the apparatus of the present invention further comprises: a shielding ring 324 of width ranged between 2~26 mm, which is arranged on top of the mesh shaped anode 326 and is made of polypropylene or polyvinyl fluoride. The separating plate 328 arranged under the mesh shaped anode has a hole 330 location at the center thereof. The diameter of the hole 330 is ranged between 5~40 mm. Moreover, the separating plate 328 is inclined from the rim thereof toward the hole 330 in an angle between 5~40 degree, such that the inclination can enable the electrolyte to fully contact with the mesh shaped anode 326 during electroplating, and consequently, improve the stability and homogeneity of the flow field during electroplating process.

Furthermore, in the aforesaid preferred embodiment, the strut 310 having a first end 316 connecting to the separating plate 328, and a corresponding second end 318 connecting to the baffle 308 is arranged below the separating plate 326 such that the electrolyte transported by the pipe 306 to the electroplating tank 302 is first rectified by the baffle 308 and the strut 310, and then flowed into the hole 330 at the center of the separating plate 328. In this regard, the impact force of the electrolyte can be reduced such that the asymmetry of flow field caused by the shape, the length or the skewed angle of the pipe 306 can be eliminated effectively.

Figure 4:
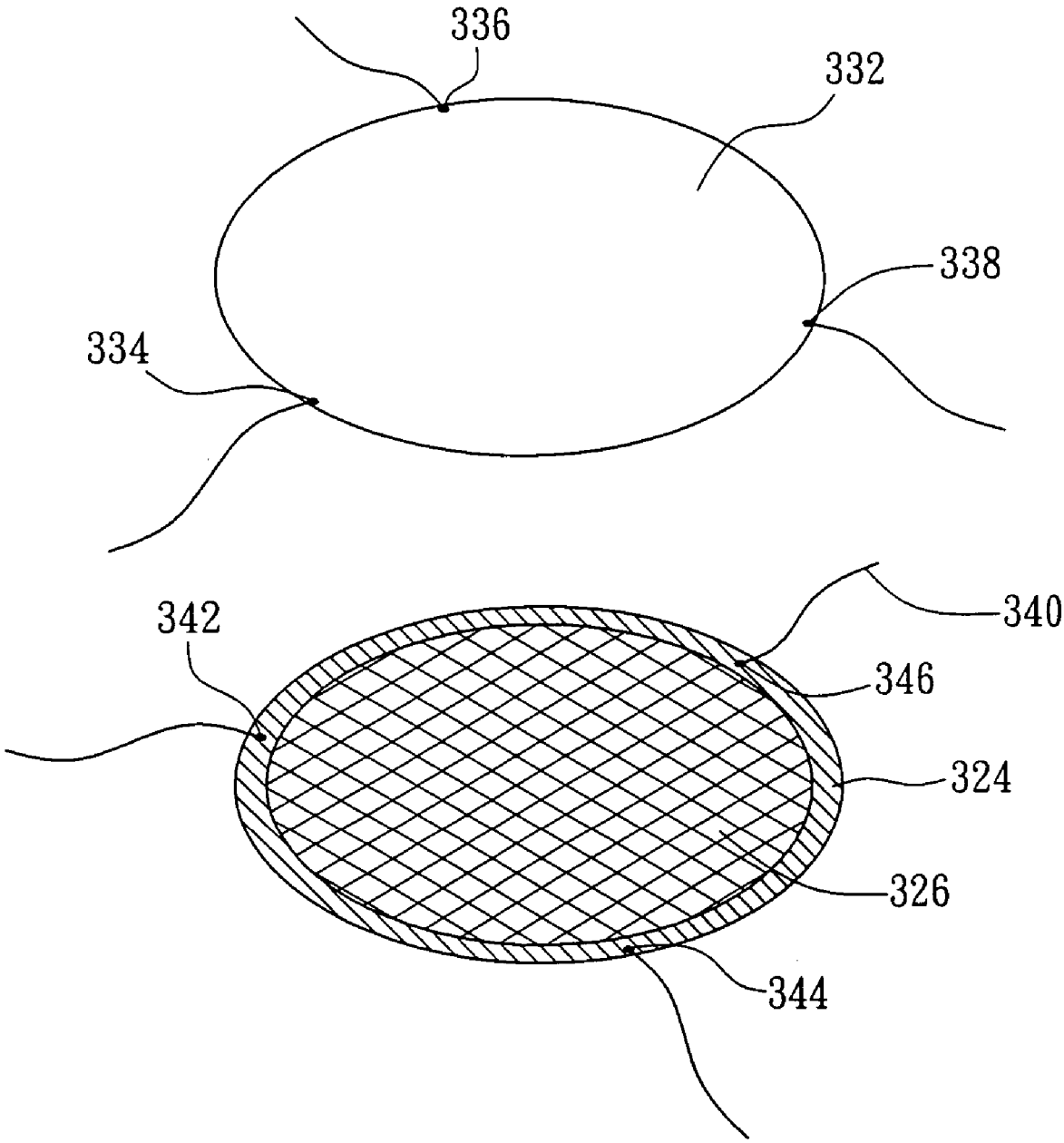
FIG. 4 is a schematic drawing showing the arrangement of a substrate and an mesh shaped anode according to the preferred embodiment of FIG. 3.

FIG. 4 is a schematic drawing showing the arrangement of a substrate and an mesh shaped anode according to the preferred embodiment of FIG. 3. As seen in FIG. 3 and FIG. 4, a shielding ring 324 of 2~26 mm width is arranged on top of the mesh shaped anode 326 for covering the outer rim of the mesh shaped anode 326 so as to reduce the influence of the excessive electric lines caused by the edge effect. The influence of the edge effect will cause the charges to concentrate densely around the outer rim of the substrate, and consequently, result in an inhomogeneous electroplating layer. The shielding ring 324 is capable of reducing the influence of edge effect and therefore enhancing the homogeneity of flow field. The shielding ring 324 is made of materials, such as: polypropylene and polyvinyl fluoride.

As seen in FIG. 4, the circumference of the mesh shaped anode 326 has a first joint 342, a second joint 344, and a third joint 346, each of which is spaced by an angle about 80~160 degrees, moreover, the circumference of the substrate 332 also has a first joint 334, a second joint 336, and a third joint 338, each of which is spaced by an angle about 80~160 degrees and is positioned complementary to the corresponding joint of the mesh shaped anode 326, such that such that the distribution of charge density may be compensated. Also, the connecting lines connected to the joints of the mesh shaped anode 326 are made of materials of impedance higher than gold, such as titanium or platinum. Though the titanium connecting line or the platinum connecting has excellent conductivity and superior anti-oxidization capability, the impedance thereof is higher than gold such that charges will not concentrate around the connecting line and the unevenness of metal ions can be avoided.

Figure 5:
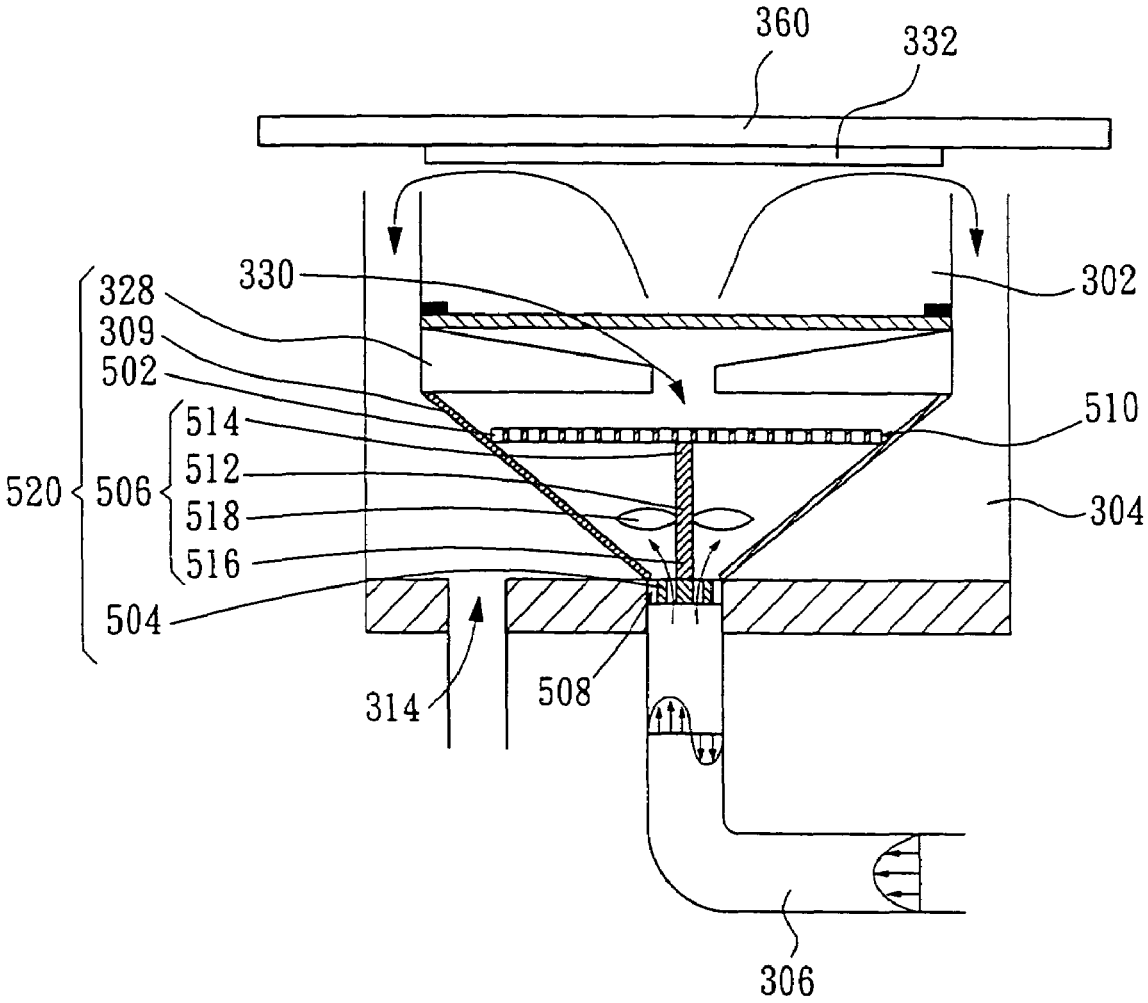
FIG. 5 is a diagram showing another preferred embodiment of the fountain-type electroplating apparatus with functions of voltage detection and flow rectification according to the present invention.

Please refer to FIG. 5, which is a diagram showing another preferred embodiment of the fountain-type electroplating apparatus with functions of voltage detection and flow rectification according to the present invention. The fountain-type electroplating apparatus of the embodiment mainly comprises a plating tank 302, an overflow tank 304, and a rectification device 520. Wherein, the plating tank 302 and the overflow tank 304 are substantially similar to those of aforementioned embodiments, so they won't be repetitiously described herein. However, the rectification device 520 of the present embodiment comprises: a separating plate 328; a hull 309; a disperser 502 having plural pores 510; a guiding plate 504 having plural orifices for slowing down the flowing of electrolyte; and an agitator 506 having an axial 512 and at least a propelling blade 518 arranged at the axial 512; wherein, the axial 512 of the agitator 506 has a first end connecting to the disperser 502 and a second end connecting to the guiding plate 504. Thus, when the electrolyte is being transported through the pipe 306, the electrolyte is first flow through the guiding plate 504 toward the propelling blade 518 so that the propelling blade 518 is rotate by the impact force of the electrolyte and, during the rotation, the electrolyte is mixed uniformly. Afterward, the disperser 502 will disperses the electrolyte one more time before the electrolyte flow through the hole 330 of the separating plate 328 and into the electroplating tank 302. Therefore, the flow field of the electrolyte in the electroplating tank 302 is very uniformly and symmetrically distributed such that the stability and evenness of the electroplating process is enhanced.

Figure 6:
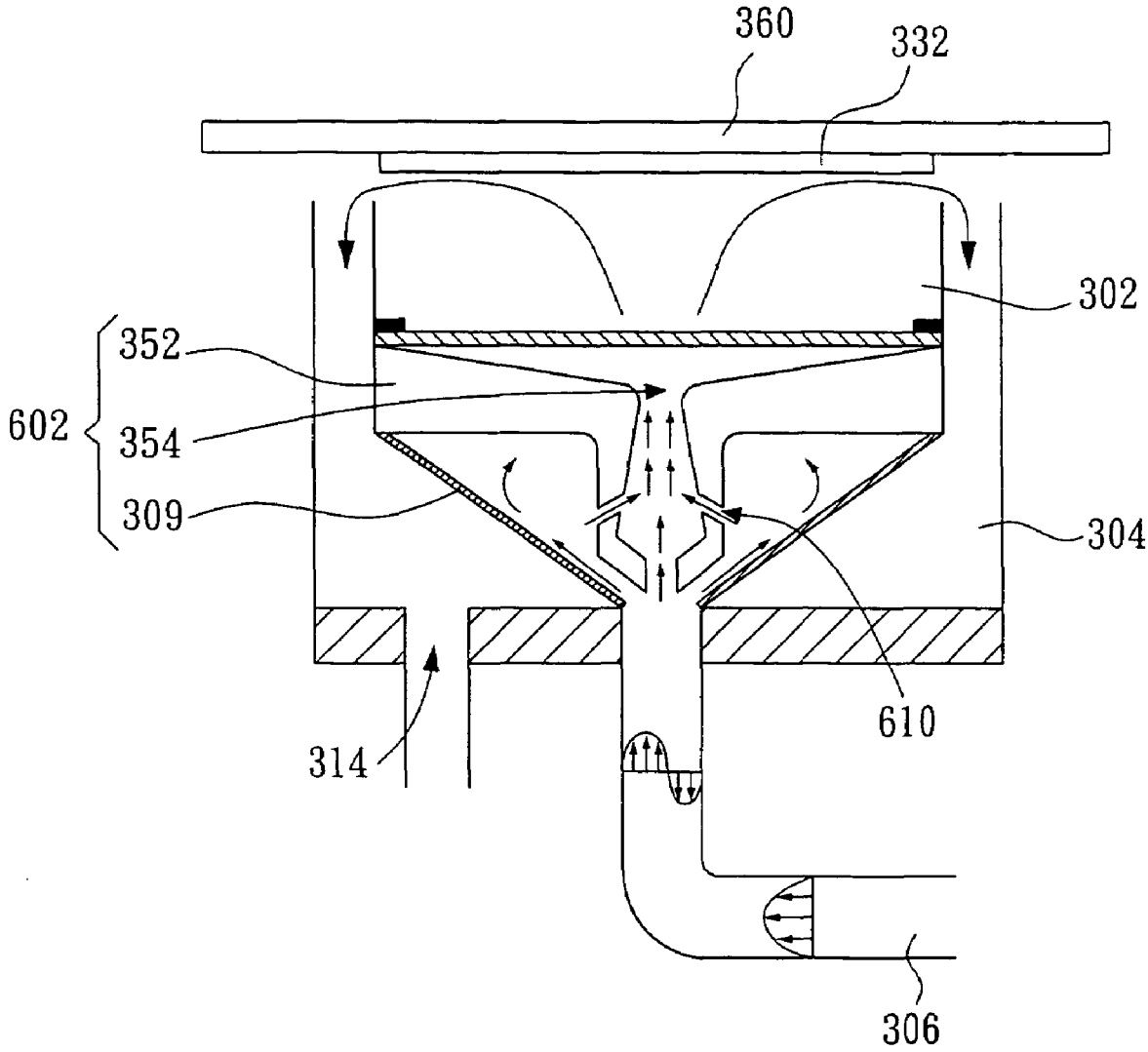
FIG. 6 is a diagram showing yet another preferred embodiment of the fountain-type electroplating apparatus with functions of voltage detection and flow rectification according to the present invention.

Please refer to FIG. 6, which is a diagram showing yet another preferred embodiment of the fountain-type electroplating apparatus with functions of voltage detection and flow rectification according to the present invention. The fountain-type electroplating apparatus of the embodiment mainly comprises a plating tank 302, an overflow tank 304, and a rectification device 602. Wherein, the plating tank 302 and the overflow tank 304 are substantially similar to those of aforementioned embodiments, so they won't be repetitiously described herein. However, the shape of the separating plate 352 of the rectification device 602 of the present embodiment is different. As seen in FIG. 6, the separating plate 352 is downward extended from the central hole 354 to the lower portion of the overflow tank 304 or on top of the pipe 306, and the hull 309 is connected to the pipe 306, moreover, a plurality of orifices 610 arranged at the end and the two extension part of the separating plate 352 whose diameter is about 0.5~4 mm and the total cross-sectional area thereof is equal to or larger than the cross-sectional area of the hole 354. The electrolyte is first accumulated at the two sides of the separating plate 352, and thereafter guided into the electroplating tank 302 through the orifices 610 such that the irregularity of the flow field is eliminated.

Figure 7:
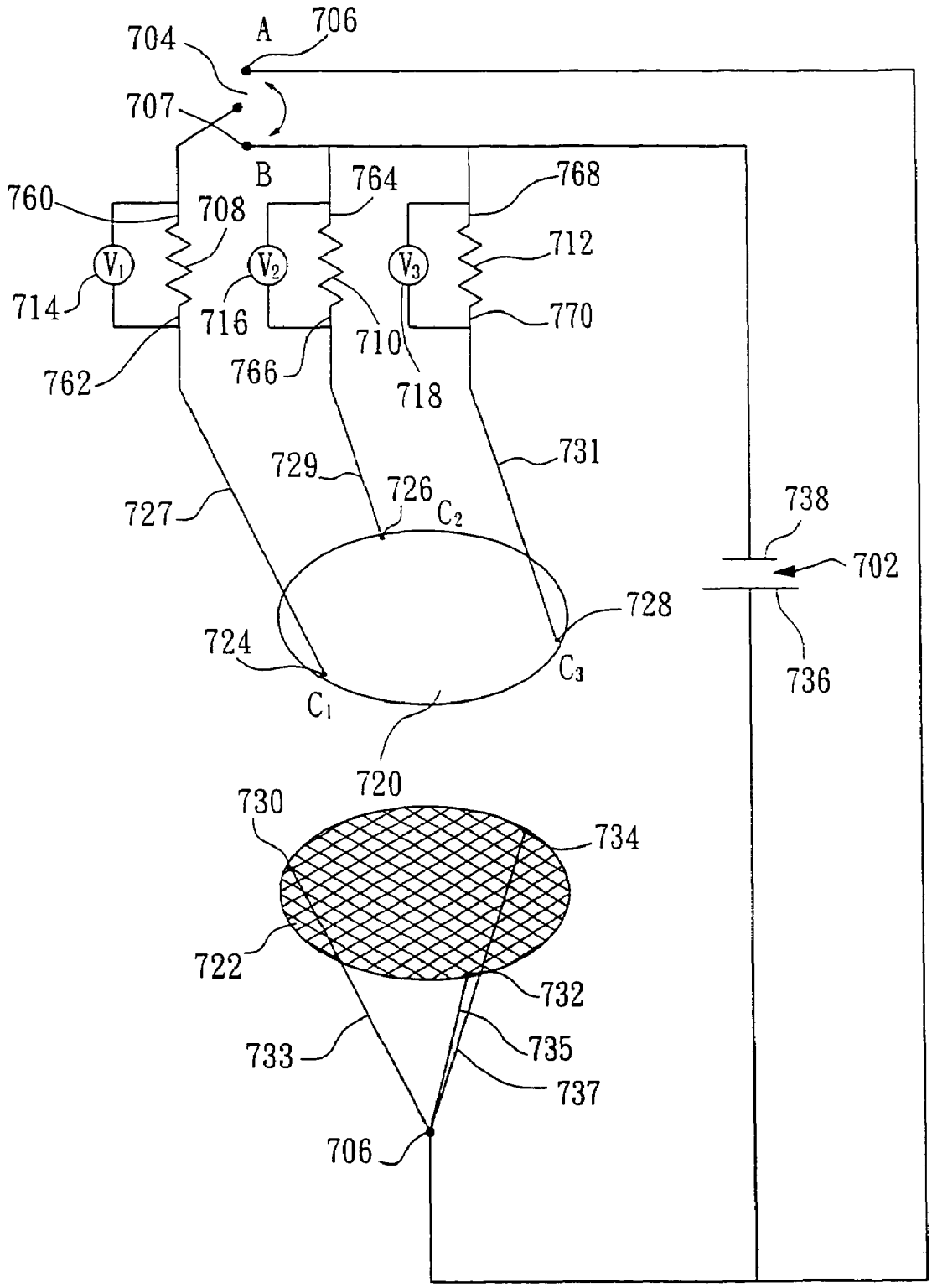
FIG. 7 is a circuitry for voltage detection according to a preferred embodiment of the present invention.

Please refer to FIG. 7, which is a circuitry for voltage detection according to a preferred embodiment of the present invention. As seen in FIG. 7, the preferred embodiment of the present invention provides a circuitry for voltage detection comprising:

- a power supplier 702 having a positive electrode 736 and a negative electrode 738;
- a switcher 704, which has a first switching point 706 connection to the positive electrode 736 and a corresponding second switching point 707 connecting to the negative electrode 738;
- three detection circuits 727, 729, 731, respectively having a first end 760, 764, 768 and a second end 762, 766, 770, and the detection circuits 727 is composed of a first resistance 708 parallel connecting to a first voltmeter 714, the detection circuits 729 is composed of a second resistance 710 parallel connecting to a second voltmeter 716, and the detection circuits 731 is composed of a third resistance 712 parallel connecting to a third voltmeter 718; and
- three connecting lines 733, 735, 737, each having one end respectively connecting to a joint of the mesh shaped anode 722, i.e. a first joint 730, a second joint 732 and a third joint 734, and all of each having another ends connecting jointly to a node and further connecting to both the positive electrode 7360 and the first switching point 706;

wherein, the first end the detection circuit 727 is connected to the switch 704 for switching between the first switch point 706 and the second switching point 707, and the first ends of the other detection circuits 729, 731 are connected jointly to a node and further connected to both the negative electrode 738 and the second switching point 707, in addition, the second ends 762, 766, 770 of the detection circuits 727, 729, 731 are respectively connected to three joints of the substrate 720, i.e. a first joint 724, a second joint 726 and a third joint 728.

In the aforesaid embodiment, the first joint 724, the second joint 726, and the third joint 728 of the substrate 720 are located at the outer rim of the substrate 720 and are spaced by an angle about 80~160 degrees to each other, and the substrate 720 may be a silicon wafer. Moreover, the first joint 730, the second joint 732, and the third joint 734 of the mesh shaped anode 722 are located at the outer rim of the mesh shaped anode 722 and are spaced by an angle about 80~160 degrees to each other. The positions of the first joint 730, the second joint 732, and the third joint 734 of the mesh shaped anode 722 are correspondingly arranged complementary to the positions of the first joint 724, the second joint 726, and the third joint 728 of the substrate 720 to compensate the uneven distribution of charge density. Furthermore, the connecting line 733, 735, 737 are made of metallic line materials, such as titanium line or platinum line, which have superior anti-oxidation and excellent conductivity, such that there won't be too many charges accumulated at the neighborhood of the connecting line, and may prevent the mesh shaped anode 722 from electrolyzing too many metallic ions from the electrolyte for obtaining a more uniform electroplating layer.

Figure 8:
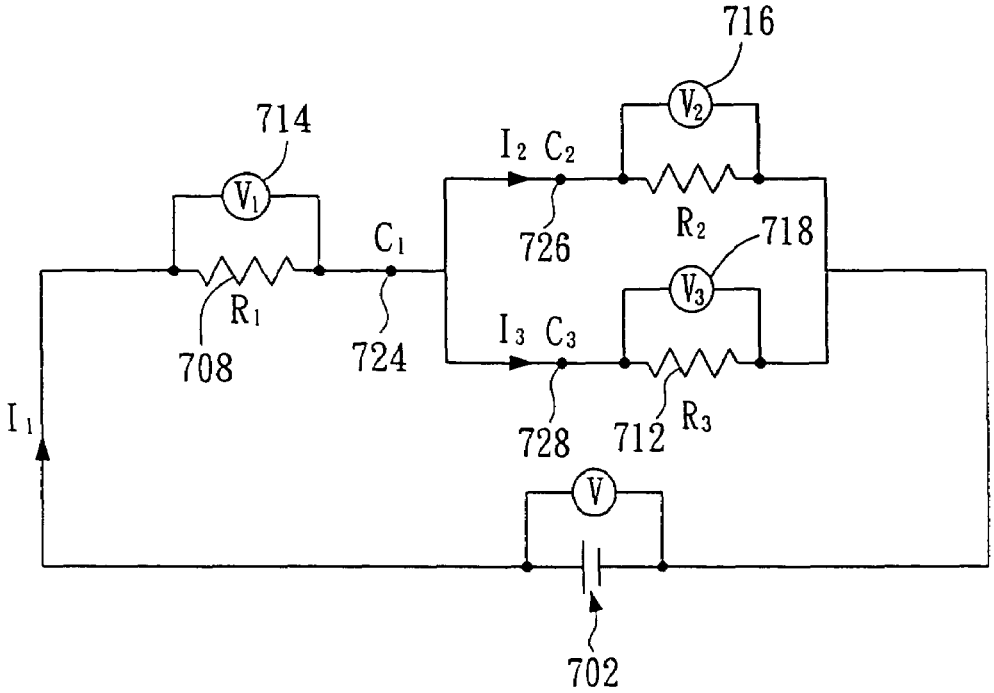
FIG. 8 is a circuitry that the first resistance is coupled to the first switching point according to FIG. 7.

FIG. 8 is a circuitry that the first resistance is coupled to the first switching point according to FIG. 7. In this preferred embodiment, the first resistance 708 is coupled to the first switching point 706 of the switcher 704 and a current I is applied. The current I will pass sequentially through the first resistance 708, the substrate 720, the second resistance 710, and the third resistance 712 to form a circuit as the following equations:

$$I=I_1=I_2=I_3$$

$$V=I\times[R_1708+R_2710\times R_3712/(R_2710+R_37120)]$$

since $R_1$708=$R_2$710=$R_3$712=R, thus V=3/2I×R wherein, $I_1$ is the current that passes through the first resistance 708; $I_2$ is the current that passes through the second resistance 710; $I_3$ is the current that passes through the third resistance; V is the voltage of the power supplier 702.

As the above equations, when a constant current I is applied under normal condition, the voltage of the power supplier 702 is V=3/2I×R. In this regard, an evaluation can be made before the electroplating process to determine whether the electric conduction of the first joint 724, the second joint 726, and the third joint 728 of the substrate 720 is normal or not.

Please refer to FIG. 8. If the voltage of the first voltmeter 714 is zero, that is no current is passing through, the voltages of the second voltmeter 716 and the third voltmeter 718 must be zero as well, therefore, the apparatus, at this time, will stop the electroplating process and issue an alarm to notify the operator. There are three possible situations for inducing the above abnormal: (1) the first joint 724 is disconnected; (2) the second joint 726 and the third joint 728 are disconnected simultaneously; (3) the first joint 724, the second joint 726, and the third joint 728 are disconnected simultaneously. The reasons for causing the disconnection of the first joint 724, the second joint 726, and the third joint 728 are as follows: (1) the electrolyte permeates into the first joint 724, the second joint 726, and the third joint 728, or foreign objects, such as oxides, adhere to the first joint 724, the second joint 726, and the third joint 728; (2) the substrate 720 is not positioned accurately or is skewed, such that the first joint 724, the second joint 726, and the third joint 728 of the substrate 720 are unable to contact with the conductive layer (not shown) of the substrate 722 and consequently result in the circuit break.

Furthermore, if the voltage of the first voltmeter 714 is equal to I×R but the voltage of the power supplier is higher than normal value, for example, the exceeding about 20%, then it may presume that either the second joint 726 or the third joint 728 is permeated by the electrolyte or is adhered by foreign objects such that the equivalent impedance of the circuit is increased. Hence, before the electroplating process, if the voltage any measured resistance is larger than the predetermined value, then the apparatus will issue an alarm to notify the operator.

Figure 9:
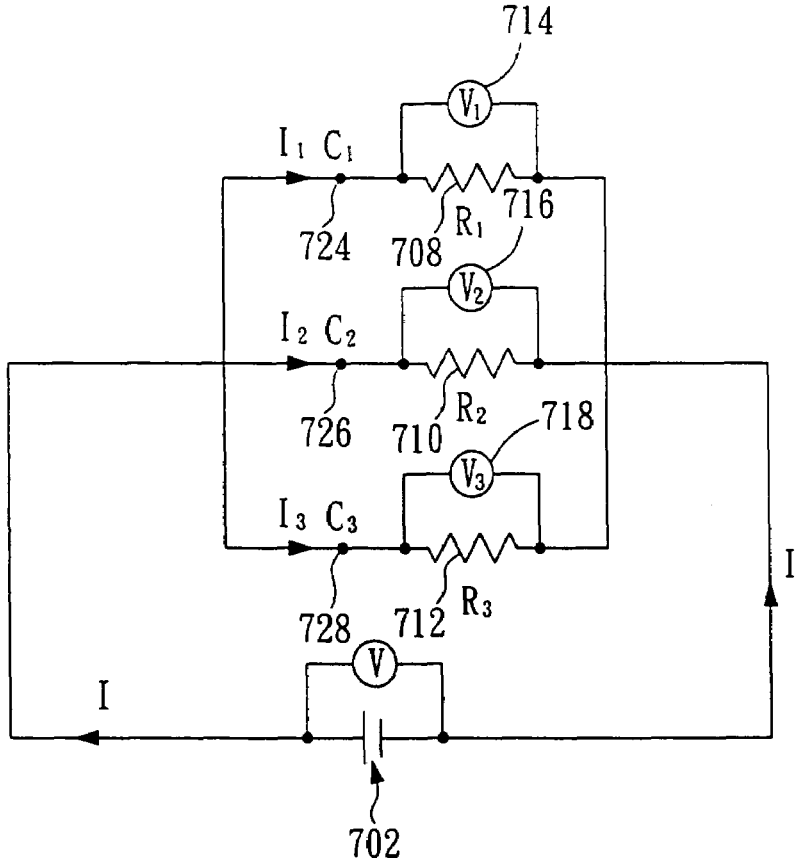
FIG. 9 is a circuitry that the first resistance is coupled to the second switching point according to FIG. 7.

FIG. 9 is a circuitry that the first resistance is coupled to the second switching point according to FIG. 7. As seen in FIG. 9, the first resistance 708 is coupled to the second switching point 707 of the switcher 704 and a current I is applied in the electroplating process, then the current I will sequentially pass through mesh shaped anode 722, the plating solution, and to the surface of the substrate 720 to form a circuit. Under normal condition, $I_1=I_2=I_3=1/3I$, and $R_1$708=$R_2$710=$R_3$712=R, thus, the voltage between two ends of the first resistance 708, the second resistance 710, and the third resistance 712 is, $V_1$714=$V_2$716=$V_3$718=(I×R)/3. Therefore, the value of (I×R)/3 may be taken as a standard to determine whether the electric conduction of the first joint 724, the second joint 726, and the third joint 728 of the substrate 720 is normal or not.

In this regard, if the voltage of the first voltmeter 714 is zero, it means that there is a disconnection happened at the first joint 724 of the substrate 720. The situation is similar to those of the second voltmeter 716 and the third voltmeter 718.

Furthermore, if the voltage of the first voltmeter is smaller than a predetermined value, for example, 90% of (I×R)/3, it represents that the electric conduction of the first joint 724 of the substrate 720 is abnormal. The situation is similar to those of the second joint 726 and the third joint 728.

Yet, if the voltages of the first voltmeter 714, the second voltmeter 716, and the third voltmeter 718 are all equal to zero, then there are three possible situations: (1) the liquid level of the electrolyte in the electroplating tank is too low to contact the substrate 720, so the current is unable to pass through; (2) there are bubbles generated on the surface of the substrate 720, so the current is disconnected; (3) the electrolyte permeate into the first joint 724, the second joint 726, and the third joint 728 of the substrate 720 at the electroplating process, so the first joint 724, the second joint 726, and the third joint 728 are disconnected simultaneously. Hence, during the electroplating process, if the voltage value of any resistance is lower than a predetermined value, the apparatus will interrupt the electroplating process and issue an alarm to notify the operator.

To sum up, the fountain-type electroplating apparatus with functions of voltage detection and flow rectification according to the present invention at least have following advantages:

(1) The present invention is capable of rectifying the electrolyte using the rectification device to buffer the impacting force so as to obtain a more uniformly and stably distributed flow field.

(2) The fountain-type electroplating apparatus of the present invention further comprise a shielding ring arranged above the mesh shaped anode for enabling the electric field in the electroplating tank to be more uniformly distributed.

(3) The mesh shaped anode of the present invention adopt a three-point contact method for connecting the connecting lines, and the connecting line is made of materials, such as titanium line or platinum line, moreover, the positions of the joints of the mesh shaped anode are complementary arranged and corresponding to the positions of the joints of the substrates to compensate the distribution of charge density, such that the homogeneity of charge density may be enhanced.

(4) The present invention is capable of detection the unstable voltage caused by unstable impedance during and before the electroplating process.

(5) The cost for setting up the apparatus of the present invention is substantially low, and it is apparently suitable for mass production.

However, the aforementioned description is only preferable embodiments according to the invention and should not be used for restricting the range of the invention. Any equivalent variation and modification made according to the claims of the invention still possess the merits of the invention and also within the spirits and fields of the invention, so they should be deemed as further executing situations of the invention. So, the protecting range of the invention should be fixed according to the claims claimed thereinafter.

What is claimed is:

1. A fountain-type electroplating apparatus with functions of voltage detection and flow rectification, comprising:

an electroplating tank having a shell, a substrate cathode electrode arranged on top of the shell, a circumference of the substrate electrode having a plurality of joints, and a mesh shaped anode arranged at the bottom of the shell, a circumference of the mesh shaped anode having a plurality of joints;

a switcher having a first switching point and a corresponding second switching point, the switcher alternately operating with either a positive electrode or a negative electrode;

a plurality of connecting line, each of which having one end connected to one of the joints of the mesh shaped anode, and all of each having another ends connected jointly to a node and to both the positive electrode and the first switching point;

a plurality of detection circuits, wherein, the first end of one of the detection circuit is connected to the corresponding second switching point, and the first ends of the other of the detection circuits are connected jointly to a node and to both the negative electrode and the second switching point, all the second ends of the detection circuits are respectively connected to the joints of the substrate;

a rectification device having a hull, a separating plate arranged under the mesh shaped anode and a pipe connecting to the hull for transporting an electrolyte therein, the separating plate having at least a hole and being connected to and arranged inside the hull; and an overflow tank having an exit hole arranged at the bottom thereof;

wherein the electroplating tank is positioned inside the overflow tank, and the rectification device is arranged under the electroplating tank.

2. The apparatus according to claim 1, further comprising a shielding ring arranged on top of the mesh shaped anode, the shielding ring having a width of between 2~26 mm.

3. The apparatus according to claim 1, wherein the separating plate has a hole location at the center thereof and the separating plate is inclined from the rim thereof toward the hole in an angle between 5~40 degree.

4. The apparatus according to claim 3, wherein the shape of the separating plate is not limited to be any geometric shape, and the separating plate extends from the central hole toward the top of the pipe, a plurality of orifices having diameter between 0.5~4 mm being arranged at the end and the two extension part of the separating plate.

5. The apparatus according to claim 1, wherein the rectification device further comprises:

a baffle; and a strut having a first end connected to the separating plate and a corresponding second end connected to the baffle.

6. The apparatus according to claim 1, wherein the rectification device further comprises:

a disperser having a plurality of pores;

a guiding plate having a plurality of orifices, and being connected to the hull;

an agitator having an axis and at least a propelling blade arranged at the side of the axis;

wherein, the axis of the agitator has a first end connected to the disperser and a second end connected to the guiding plate.

7. The apparatus according to claim 1, wherein the circumference of the substrate has a first joint, a second joint and a third joint, and the three joints are spaced by an angle about 80~160 degrees from each other.

8. The apparatus according to claim 1, wherein the circumference of the mesh shaped anode has a first joint, a second joint and a third joint, and the three joints are spaced by an angle about 80~160 degrees from each other.

9. The apparatus according to claim 1, wherein the joints of the substrate is complementary arranged to the joints of the mesh shaped anode.

10. The apparatus according to claim 1, wherein each of the detection circuits has a first end and a second end and is composed of a resistance parallel connected to a voltmeter.

11. The apparatus according to claim 10, wherein the switcher includes a relay for switching between the first switching point and the second switching point.

12. The apparatus according to claim 1, wherein the positive electrode and the negative electrode connected to a power supplier.

* * * * *